US011359298B2

(12) United States Patent
Uda et al.

(10) Patent No.: US 11,359,298 B2
(45) Date of Patent: Jun. 14, 2022

(54) METHOD FOR PRODUCING TITANIUM FOIL OR TITANIUM SHEET, AND CATHODE ELECTRODE

(71) Applicants: KYOTO UNIVERSITY, Kyoto (JP); NIPPON STEEL CORPORATION, Tokyo (JP)

(72) Inventors: Tetsuya Uda, Kyoto (JP); Kouhei Funatsu, Kyoto (JP); Akihiro Kishimoto, Kyoto (JP); Kenichi Mori, Tokyo (JP); Hideki Fujii, Tokyo (JP)

(73) Assignees: KYOTO UNIVERSITY, Kyoto (JP); NIPPON STEEL CORPORATION, Tokyo (JP)

( * ) Notice: Subject to any disclaimer, the term of this patent is extended or adjusted under 35 U.S.C. 154(b) by 100 days.

(21) Appl. No.: 16/490,289

(22) PCT Filed: Mar. 1, 2018

(86) PCT No.: PCT/JP2018/007872
§ 371 (c)(1),
(2) Date: Aug. 30, 2019

(87) PCT Pub. No.: WO2018/159774
PCT Pub. Date: Sep. 7, 2018

(65) Prior Publication Data

US 2020/0385881 A1 Dec. 10, 2020

(30) Foreign Application Priority Data

Mar. 1, 2017 (JP) ..... JP2017-038767
Mar. 1, 2017 (JP) ..... JP2017-038768

(51) Int. Cl.
*C25D 1/20* (2006.01)
*C25D 1/04* (2006.01)
*C25D 3/54* (2006.01)

(52) U.S. Cl.
CPC ..... *C25D 1/04* (2013.01); *C25D 1/20* (2013.01); *C25D 3/54* (2013.01)

(58) Field of Classification Search
None
See application file for complete search history.

(56) References Cited

U.S. PATENT DOCUMENTS 951,365 A * 3/1910 Cowper-Coles ..... 156/150
3,434,938 A * 3/1969 Van Sciver ..... C25D 1/08 205/75

(Continued)

FOREIGN PATENT DOCUMENTS

JP 48-28538 B1 9/1973
JP 57-104682 A 6/1982

(Continued)

OTHER PUBLICATIONS

"Foreign Vanadium Titanium (vol. 11)", Chongqing Branch of the Institute of Scientific and Technical Information of China, 1st edition in Oct. 1979, pp. 139-143.

(Continued)

*Primary Examiner* — Stefanie S Wittenberg
(74) *Attorney, Agent, or Firm* — Birch, Stewart, Kolasch & Birch, LLP

(57) ABSTRACT

A titanium foil or a titanium sheet is produced by electrodeposition from molten salt using constant current pulse, the method comprising: forming an electrodeposited titanium film on a surface of a cathode electrode made of glassy carbon, graphite, Mo, and Ni, and separating thereafter the electrodeposited titanium film from the cathode electrode by performing one or both of applying an external force to the electrodeposited titanium film and removing the cathode electrode. This enables the electrodeposited titanium film (Continued)

electrodeposited on the cathode electrode to be peeled from the cathode electrode simply and at low cost.

2 Claims, 13 Drawing Sheets

(56) References Cited

U.S. PATENT DOCUMENTS

| | | | |
|---|---|---|---|
| 3,662,047 | A | 5/1972 | Tokumoto et al. |
| 4,521,281 | A | 6/1985 | Kadija |

FOREIGN PATENT DOCUMENTS

| | | | |
|---|---|---|---|
| JP | 2-213490 | A | 8/1990 |
| JP | 8-142398 | A | 6/1996 |
| JP | 2000-86225 | A | 3/2000 |

OTHER PUBLICATIONS

Chen et al., "Investigation of Titanium Electroplating in Molten Salts," Electroplating & Finishing, vol. 18. No. 2, pp. 31-36, with an English abstract.

Machine translation of JP-2000-086225-A, published on Mar. 28, 2000.

1st Office Action for JP 2018-541234 dated Dec. 11, 2018.

International Search Report for PCT/JP2018/007872 dated Apr. 3, 2018.

Robin et al., "Pulse electrodeposition of titanium on carbon steel in the LiF—NaF—KF eutectic melt", Journal of Applied Electrochemistry, 2000, vol. 30, pp. 239-246.

Takamura et al., "Smooth and Fine Electrodeposition of Titanium from LiCl—KCl—$TiCl_3$ Melt", J. Japan Inst. Metals, 1996, vol. 60, No. 4, pp. 388-397.

Wei et al., "Characteristics of Ti Films Electrodeposited from Molten Salts by a Pulse Current Method", J. Japan Inst. Metals, 1994, vol. 58, No. 6, pp. 660-667.

Wei et al., "Electrodeposition of Ti Films by Pulse Current in Molten Salt, and Films Characteristics", Journal of the Surface Finishing Society of Japan, 1993, vol. 44, No. 1, pp. 33-38.

Written Opinion of the International Searching Authority for PCT/JP2018/007872 (PCT/ISA/237) dated Apr. 3, 2018.

Robin et al., "Pulse Electrodepostion of Titanium on Carbon Steel in the LiF—NaF—KF Eutectic Melt," Journal of Applied Electrochemistry, vol. 30, 2000, pp. 239-246.

* cited by examiner

| Mo#03 | |
|---|---|
| Photo | Secondary Electron Image |
|  |   1 (at.%) Ti: 100, Mo: n.d. |
| Mo#01 | |
| Photo | Secondary Electron Image |
|  |  1 (at.%) Ti: 100, Mo: n.d. |
| SUS#01 | |
| Photo | Secondary Electron Image |
|  |   1 (at.%) Ti: 99.9, Fe: 0.1, Ni: n.d., Cr: n.d.<br>2 (at.%) Ti: 72.0, Fe: 15.7, Ni: 5.5, Cr: 6.8 |
| Ni#02 | |
| Photo | Secondary Electron Image |
|  |   1 (at.%) Ti: 86.3, Ni: 13.7<br>2 (at.%) Ti: 96.4, Ni: 3.6 |

| Grassy Carbon #01-1 | |
|---|---|
| Photo | Secondary Electron Image |
|  |  <br>1 (at.%) Ti: 99.2, C: 0.8<br>2 (at.%) Ti: 91.2, 8.8 |
| Grassy Carbon #01-2 | |
| Photo | Secondary Electron Image |
|  |  <br>1 (at.%) Ti: 86.3, C: 13.7<br>2 (at.%) Ti: 98.3, C: 1.7 |
| Graphite #02 | |
| Photo | Secondary Electron Image |
|  |  <br>1 (at.%) Ti: 99.2, C: 0.7<br>2(at.%) Ti: 87.5, C: 12.5 |

METHOD FOR PRODUCING TITANIUM FOIL OR TITANIUM SHEET, AND CATHODE ELECTRODE

TECHNICAL FIELD

The present invention relates to a method for producing titanium foil or a titanium sheet, and to a cathode electrode.

BACKGROUND ART

A titanium foil or a titanium sheet (hereafter, referred to collectively as a "titanium sheet") is used for, for example, automobile, aircraft, battery components, substrates, and electrodes that are required to be lightweight, and materials for corrosion-resistant filters, anticorrosion sheets, semiconductor wiring, and corrosion-resistant functional materials.

In conventional practice, a titanium sheet is produced typically by a method including: performing upgrading or the like on titanium ore (main component: ilmenite $FeTiO_3$) to produce a raw material of a high-purity $TiO_2$ (85 to 93% pure synthetic rutile $TiO_2$); chloridating the raw material to convert it into titanium tetrachloride $TiCl_4$; distilling the titanium tetrachloride repeatedly to purify it, producing a high-purity $TiCl_4$; subjecting the high-purity $TiCl_4$ to the Kroll process, the Hunter process, the electrolytic process, or the like to produce metallic titanium (sponge titanium); thereafter performing melting, casting, and blooming the metallic titanium; and in addition, repeating rolling and annealing to make the metallic titanium have an intended thickness, or performing vapor phase reaction such as sputtering on the purified metallic titanium as raw material to form a film of titanium.

However, producing a titanium sheet in this manner, in which the metallic titanium is produced and then reworked into the titanium sheet to have the intended thickness, leads to multi-stepped and complex processes and to significant increase in production costs; hence, there is a demand for an approach by which the metallic titanium is taken directly in a form close to a foil or a sheet when the metallic titanium is reduced from the titanium compound material.

As a method by which titanium is produced directly from titanium compound, electrodeposition from molten salt is known. Patent Document 1 discloses an invention of a method for producing a high-purity titanium, in which sponge titanium is added to a molten salt bath containing molten sodium chloride, and additionally, titanium tetrachloride is introduced in the molten salt bath to prepare an electrolytic bath containing $TiCl_2$ and $TiCl_3$, from which titanium is electrodeposited.

Patent Document 2 discloses an invention in which a titanium thin film coating is applied to a stainless steel electrode by pulse electrolysis in molten salt using a chloride bath.

Patent Document 3 discloses an invention that provides an electrodeposited substance such as titanium having a smooth surface by applying rotation and precession to a cathode in molten salt electrodeposition.

Non-Patent Document 1 discloses an invention of a method for producing a titanium thin film by performing pulse electrolysis in molten salt using a stainless steel (SUS304) as a cathode electrode and using an electrolytic bath in which $K_2TiF_6$ is added to a chloride bath.

Non-Patent Document 2 discloses an invention in which a carbon steel is used as a cathode electrode, and titanium is electrodeposited from an electrolytic bath in which $K_2TiF_6$ is added to a LiF—NaF—KF bath.

Non-Patent Document 3 discloses that a smooth electrodeposited titanium film is obtained by using LiCl—KCl—$TiCl_3$ molten salt and using a Au substrate as a cathode.

LIST OF PRIOR ART DOCUMENTS

Patent Document

Patent Document 1: JP2-213490A
Patent Document 2: JP8-142398A
Patent Document 3: JP57-104682A

Non Patent Document

Non-Patent Document 1: Dawei WEI et al., "Electrodeposition of Ti Films by Pulse Current in Molten Salt, and Films Characteristics," Journal of the Surface Finishing Society of Japan, Vol. 44, No. 1 (1993), pp.33-38

Non-Patent Document 2: ROBIN et al. "Pulse electrodeposition of titanium on carbon steel in the LiF—NaF—KF eutectic melt" J. Appl. Electrochem. Vol. 30 (2000), pp.239-246

Non-Patent Document 3: Takamura et al. "Smooth and Fine Electrodeposition of Titanium from LiCl—KCl—$TiCl_3$ Melt", J. Japan Inst. Met. Mater. Vol. 60, No. 4 (1996), pp.388-397

SUMMARY OF INVENTION

Technical Problem

However, the electrodeposited titanium film precipitating on the cathode electrode by the electrodeposition from molten salt is firmly adhered and cannot be peeled easily. Accordingly, although a titanium sheet can be produced directly from a Ti compound by the electrodeposition from molten salt, this increases a cost of peeling the electrodeposited titanium film from the cathode electrode, and the titanium sheet cannot be produced at low cost.

The molten salt electrolysis can produce a smooth titanium precipitate, but it is often the case that its film thickness is about 20 μm or less, as disclosed in Patent Document 2 and Non-Patent Document 1. There is heretofore no disclosure of a technology that can provide a titanium precipitate having a larger thickness than the above and having a smooth surface and can further dispense with applying a mechanical operation (e.g., slide, rotation) on a cathode electrode or stirring the electrolytic bath.

In the example disclosed in Non-Patent Document 3, since Au, which is expensive, is used as the substrate, which increases production costs and is therefore difficult to apply to an industrial process. In addition, there are techniques, as disclosed in Non-Patent Document 2, that enable a film thickness of about 100 μm to be obtained. However, in these techniques, the raw material or the molten salt contains highly poisonous fluorides and is therefore very difficult to handle industrially.

An objective of the present invention is to provide a basic technology by which an electrodeposited titanium film electrodeposited on a cathode electrode by the electrodeposition from molten salt is peeled from the cathode electrode simply and at low cost.

Solution to Problem

The present inventors conducted intensive studies to solve the problems described above, consequently found that an electrodeposited titanium film caused to precipitate on a cathode electrode made of glassy carbon, graphite, Mo, or Ni can be peeled by a physical external force or the like simply and at low cost, and further conducted studies to make the present invention. The present invention is as follows.

(1) A method for producing a titanium foil or a titanium sheet by electrodeposition from molten salt using constant current pulse, the method comprising:

forming an electrodeposited titanium film on a surface of a cathode electrode made of one or more kinds selected from glassy carbon, graphite, Mo, and Ni, and thereafter separating the electrodeposited titanium film from the cathode electrode by performing one or both of a process of applying an external force to the electrodeposited titanium film and a process of removing at least a portion of the cathode electrode.

The method for producing a titanium foil or a titanium sheet according to the above (1), wherein the removal of the cathode electrode is performed by physical means (e.g., grinding, cutting, polishing, ion milling, blasting) or chemical means (e.g., etching).

(3) The method for producing a titanium foil or a titanium sheet according to the above (1) or (2), wherein separating the electrodeposited titanium film from the cathode electrode by grasping directly a portion of the electrodeposited titanium film and peeling the electrodeposited titanium film from the cathode electrode or bonding a separation member to a portion of the electrodeposited titanium film, grasping the separation member, and peeling the electrodeposited titanium film from the cathode electrode.

(4) The method for producing a titanium foil or a titanium sheet according to the above (1) or (2), wherein separating the electrodeposited titanium film from the cathode electrode by, on an interface between the electrodeposited titanium film and the cathode electrode, removing a portion of the cathode electrode to form a grasping portion in the portion of the electrodeposited titanium film, and thereafter, by peeling the electrodeposited titanium film from the cathode electrode with the grasping portion as a starting point, or by bonding a separation member to the grasping portion and then peeling the electrodeposited titanium film from the cathode electrode with the separation member as the starting point.

(5) A cathode electrode used for obtaining a titanium foil or a titanium sheet by electrodepositing titanium by electrodeposition from molten salt using constant current pulse, wherein at least a surface of the cathode electrode for the electrodeposition of titanium is made of one or more kinds selected from glassy carbon, graphite, Mo, and Ni.

Advantageous Effects of Invention

The present invention can provide a basic technology by which an electrodeposited titanium film electrodeposited on a cathode electrode by the electrodeposition from molten salt is peeled from the cathode electrode simply and at low cost.

This enables simplification of processes and significant suppression of production costs for producing a titanium foil or a titanium sheet, which in turn enables promotion of using titanium foils or titanium sheets.

DESCRIPTION OF EMBODIMENTS

Figure 1:
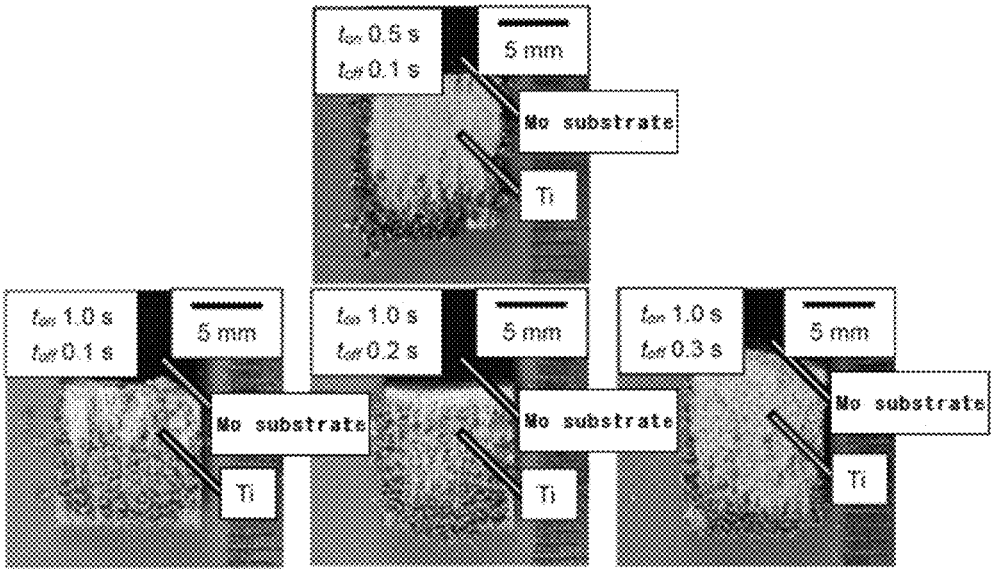
FIG. 1 is a picture illustrating substrates subjected to the electrolysis under various electrolysis conditions.

The present invention will be described. The following describes a case of a production of a titanium foil, as an example; however, the present invention enables a production of a titanium sheet having a sheet thickness of about 100 μm to 1 mm by making an electrolytic apparatus large in scale or by performing the electrodeposition for a long time. A thickness of a titanium foil or a titanium sheet obtained by the present invention is 30 μm to 1 mm.

(1) Electrodeposition from Molten Salt Using Constant Current Pulse

In the present invention, electrodeposition from molten salt using constant current pulse is employed to form an electrodeposited titanium film on a surface of a cathode electrode that is made of one or more kinds selected from glassy carbon, graphite, Mo, and Ni. Note that, in experiments described in the present specification, a strip-like electrode about 10 mm wide and 50 mm long is used as the cathode electrode. In an industrial-scale production, an electrode having a width of about 300 to 1000 mm and a length of about 500 to 2500 mm is supposed to be used. In particular, an electrode of any size commensurate to a titanium sheet to be produced is available in the present invention. To one end of the electrode, a conducting wire is connected. The electrolysis is performed with the other end of the electrode immersed in molten salt by about 10 mm. The electrode includes a fixing portion (e.g., through hole) used to, for example, screw down the electrode to fix it at a given location.

In the present invention, molten salt electrolysis using constant current pulse is employed. As a molten salt electrolytic bath, it is preferable to prepare one obtained by adding titanium ion, which serves as a titanium source in reduction and precipitation, to an alkali metal chloride bath or a mixture bath of an alkali metal chloride and an alkaline earth metal chloride. Some kinds of the chlorides may be replaced with an iodide. By feeding current between an anode electrode and the cathode electrode, titanium is caused to precipitate on a surface of the cathode electrode.

The electrolytic bath prepared in the present invention contains no fluorine. Of alkali metal chlorides, it is preferable to use LiCl, NaCl, KCl, or CsCl. Of alkaline earth metal chlorides, it is preferable to use $MgCl_2$ or $CaCl_2$.

In the present invention, unlike the Kroll process or the like, use of the electrodeposition from molten salt makes it possible to obtain a titanium foil directly from titanium compound material without producing sponge titanium. This can reduce the burden of processes of melting, casting, blooming, and in addition, repeating rolling and annealing, which can suppress an increase in stages, complexity, and production costs.

In addition, the molten salt bath contains no highly poisonous fluorides, which facilitates industrial operation.

Furthermore, as compared with fluorides, the alkali metal chlorides are inexpensive; in particular, NaCl and KCL are less expensive than LiCl, and the present invention therefore has an advantage also in this regard. Moreover, when a plurality of kinds of the alkali metal chlorides and the alkaline earth metal chlorides are mixed at close to their eutectic composition, the mixture has a lower fusing point, which is preferable.

For example, when nearly equimolar amounts of NaCl and KCl are mixed, the mixture has a low fusing point. A preferable range is NaCl-30 to 70 mol % KCl, and a more preferable range is NaCl-40 to 60 mol % KCl.

In a case of $MgCl_2$—NaCl—KCl molten salt, when they are mixed at Mg:Na:K=50:30:20 (mol %) in cation ratio, the molten salt has a low fusing point. A preferable range is Mg:Na:K=40 to 60:20 to 40:10 to 30.

It is preferable that the raw material of titanium mainly includes titanium chlorides. $TiCl_4$ has a low degree of solubility in the molten salt, and it is therefore particularly preferable to melt $TiCl_2$ to contain divalent titanium ion. In addition, $TiCl_2$ requires less number of electrons in its reduction than multivalent titanium ions such as a tetravalent titanium ion, and therefore $TiCl_2$ produces more precipitation amount of titanium with the same quantity of electricity than the multivalent titanium ions, which is preferable.

The divalent titanium ion can be obtained also by mixing $TiCl_4$ (tetravalent) and metallic titanium (zerovalent). $TiCl_4$ is used also in a current process of titanium smelting, and impurities in $TiCl_4$ can be reduced by distillation, which is advantageous to management of concentration of the impurities. In addition to the titanium chlorides, metallic titanium such as titanium scraps and sponge titanium can be used as the titanium source. The divalent titanium ion can be obtained by partial reduction of $TiCl_4$ (tetravalent) with Na, Mg, or Ca.

(2) Cathode Electrode

Forming the cathode electrode used in the electrodeposition from molten salt using constant current pulse from one or more kinds selected from glassy carbon, graphite, Mo, and Ni makes it possible to separate an electrodeposited titanium film caused to precipitate on the cathode electrode easily and at low cost using physical external force or the like.

The reason for this is unclear; however, it is presumed that such materials resist being alloyed with the electrodeposited titanium.

In the present invention, the "glassy carbon" refers to non-graphitizing carbon, which combines glass and ceramic properties, and is referred to also as "glassy carbon." The glassy carbon is used as conductive materials, crucible, parts of a prosthesis, and the like and has properties including high-temperature resistance, high hardness, low density, low electric resistance, low friction, low thermal resistance, high chemical resistance, impermeability to gases and liquids, and the like.

In Examples, a glassy carbon plate from Tokai Fine Carbon Co., Ltd, which was mirror finished and 2.0 mm thick, was used as a glassy carbon-made electrode as remaining non-surface-treated.

In Examples, a graphite plate from Tokai Fine Carbon Co., Ltd, which was 5.0 mm thick, was used as a graphite-made electrode as remaining non-surface-treated.

A Mo-made electrode refers to an electrode made of molybdenum having a purity of 99% or higher. In Examples, a molybdenum plate from Japan Metal Service, Co., Ltd, which was 99.95% pure and 0.1 mm thick, was used as the Mo-made electrode as remaining non-surface-treated.

A Ni-made electrode refers to an electrode made of nickel having a purity of 99% or higher. In Examples, a nickel plate from Japan Metal Service, Co., Ltd, which was 99+% pure and 0.2 mm thick, was used as the Ni-made electrode as remaining non-surface-treated.

The glassy carbon-made or graphite-made electrode allows an electrodeposited titanium film formed on a surface of the electrode to be separated easily by applying external force without using a jig, chemical agent, or the like.

The Mo-made electrode allows an electrodeposited titanium film to be separated by, for example, using a jig such as tweezers, pincers, and pliers, or a chemical agent such as one containing, for example, nitric acid: sulfuric acid: water=1:1:3. The Ni-made electrode allows an electrodeposited titanium film to be separated by, for example, using a jig such as tweezers, pincers, and pliers, or a chemical agent such as concentrated hydrochloric acid and dilute nitric acid. On the Ni-made electrode, the electrodeposited titanium film can be separated without using these jig and chemical agent, depending on the situation, although the separation has a problem in its repeatability.

A glassy carbon-made or Mo-made cathode electrode leaves an extremely small amount of its electrode substance adhered to a surface of a separated titanium foil (electrodeposited titanium film), which lightens a load of removing the electrode substance. In addition, the separated titanium foil (electrodeposited titanium film) has an excellent metallic luster on its surface, providing a high quality in the appearance.

Note that the cathode electrode may be entirely made of one or more kinds selected from glassy carbon, graphite, Mo, and Ni, and alternatively, a body of the electrode may be made of another material as long as at least the surface of the electrode for electrodepositing titanium is made of one or more kinds selected from these materials. As the body of the electrode, for example, a starting material having a sufficient conductivity and strength required of the electrode, such as stainless steel plate, non-stainless steel plate, and copper, can be used. This can reduce a consumption of glassy carbon, graphite, Mo, or Ni, enabling cost reduction. The number of kinds of these electrode materials to be used is not limited to one, and a plurality of kinds of these electrode materials can be used in combination.

(3) Summary of Electrolysis Conditions

In the electrolysis, constant current pulse for on/off control is used as applied current. The pulse current for on/off control means that the current is fed in such a manner as to alternate feeding a current for reduction and precipitation to the cathode electrode for a certain period of time to cause titanium to be reduced to precipitate on the cathode electrode, and thereafter cutting off the current for a certain period of time, with a value of the current left unchanged.

If the current for reduction and precipitation is continuously fed, titanium ions existing in a vicinity of the surface of the cathode electrode decrease through the reduction and precipitation. At this point, titanium ions conveyed from off the cathode electrode are not necessarily supplied to the vicinity of the electrode evenly at a constant rate commensurate with the decrease in the titanium ions existing in the vicinity of the electrode. This can make a concentration of titanium ions existing in the vicinity of the cathode electrode uneven, which is considered to be a cause of inhibiting the titanium precipitate from being smoothed.

In contrast, by providing a current cut-off time in the electrolysis, concentration diffusion occurs during this cut-off time, eliminating or mitigating the unevenness of titanium ions. Use of the pulse current is therefore considered to have an effect of averaging the concentration of titanium ions on a periphery of an interface of the precipitation, which enables the smoothing.

A pulse width of the applied current preferably has a pulse frequency of 0.1 to 10 Hz, more preferably 0.25 to 2 Hz. That is, it is preferable to set an energization period $t_{on}$, during which the current is continuously fed, at 0.05 to 5 s and set a non-energization period $t_{off}$, during which the current is cut off, at 0.05 to 5 s, similarly, and more preferable to set energization period $t_{on}$=non-energization period $t_{off}$=0.25 to 2 s.

A value of cathode current may be any value as long as the cathode current has a constant current amount (cathode current density) above a certain amount that allows the electrodeposition of titanium.

(4) An Example of Electrolysis Conditions

Investigations about electrodeposition conditions for obtaining a smooth electrodeposited titanium film (particularly about a pulse period) conducted by the present inventors, experiments conducted by the present inventors to determine the pulse period, and analysis results of the experiments will be described below.

First, non-energization periods $t_{off}$ with which a smooth electrodeposited titanium film was obtained and non-energization periods $t_{off}$ with which a smooth electrodeposited titanium film was not obtained were investigated for various energization periods $t_{on}$; next based on the investigations as a precondition, potentials during current application and potentials after current cut-off were measured, to estimate optimal energization period $t_{on}$ and non-energization period $t_{off}$. Thereafter, the precondition was examined by performing the electrodeposition from molten salt actually under the electrolysis conditions.

(4-1) Experimental Method

The electrodeposition of titanium was performed by the following method.

Molten salt: $MgCl_2$—NaCl—KCl eutectic salt (Mg:Na:K=50:30:20/mol %) (5 mol % $TiCl_2$ (cation ratio))

Working electrode: Mo or glassy carbon, Counter electrode: Ti, Reference electrode: Ti Current density: −0.200 or −0.400 A/cm$^2$ In the investigations of the conditions for obtaining a smooth electrodeposited titanium film, a Mo-made substrate was used, with current density set at −0.200 A/cm$^2$ and energization amount set at 181.8 C/cm$^2$ (equivalent to a titanium film having a thickness: 100 μm). After the electrolysis, the substrate used as the working electrode was subjected to leaching treatment to extract adhered salts in 5 mass % hydrochloric acid.

In addition, from a difference in mass of a sample before and after the electrolysis, a current efficiency was determined. In a current cut-off method, the measurements were performed using a Mo-made substrate and a glassy carbon-made substrate, with current density set at −0.200 A/cm$^2$ or −0.400 A/cm$^2$ and energization period $t_{on}$ changed as 0.5 s→1.0 s→1.5 s→2.0 s→2.5 s→3.0 s→3.5 s→4.0 s→4.5 s→5.0 s→10.0 s.

(4-2) Experimental Results and Review

FIG. 1 is a picture illustrating substrates subjected to the electrolysis under various electrolysis conditions. As illustrated in FIG. 1, with energization period $t_{on}$=0.5 s, a smooth electrodeposited titanium film was obtained even when non-energization period $t_{off}$=0.1 s. With energization period $t_{on}$=1.0 s, no smooth electrodeposited titanium film was obtained when non-energization period $t_{off}$=0.1, 0.2 s, while a smooth electrodeposited titanium film was obtained when non-energization period $t_{off}$=0.3 s. Taking the above conditions into account, the optimal energization period $t_{on}$, and non-energization period $t_{off}$ were estimated.

Figure 2:
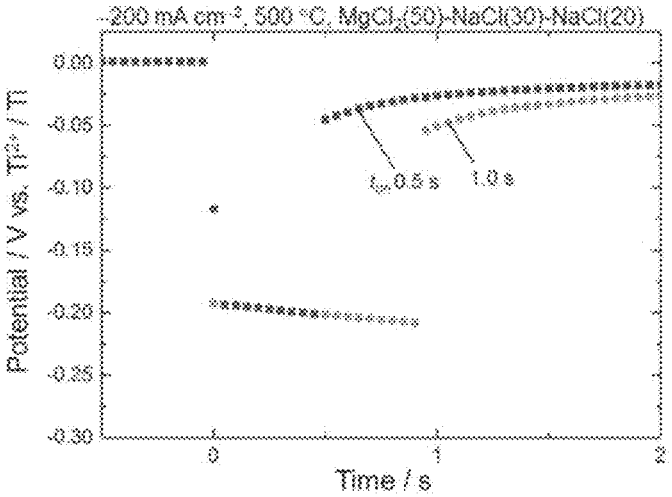
FIG. 2 is a graph illustrating potentials before and after current cut-off with current density=−0.200 A/cm$^2$, energization period $t_{on}$=0.5, 1.0 s, and a Mo-made substrate used.

FIG. 2 is a graph illustrating potentials before and after the current cut-off with current density=−0.200 A/cm$^2$, energization period $t_{on}$=0.5, 1.0 s, and the Mo-made substrate used. Note that 0 s indicates a first point since a start of the application and the measurement was performed every 0.05 ms.

Based on the graph illustrated in FIG. 2, it is assumed from the conditions for obtaining a smooth electrodeposited titanium film that the smooth electrodeposited titanium film can be obtained by setting a time that the potential takes to exceed a threshold value, which is set at −0.043 V, after the current cut-off as the non-energization period $t_{off}$.

Figure 3:
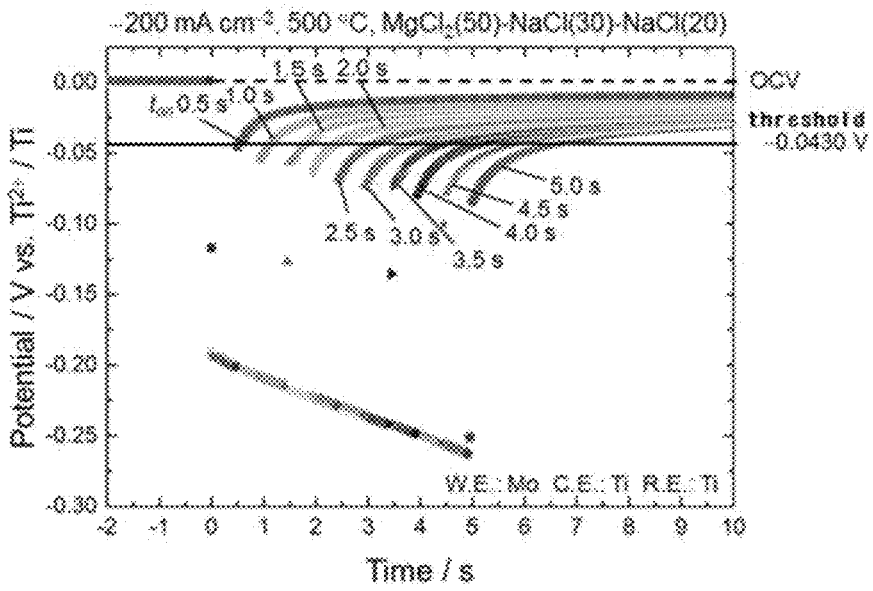
FIG. 3 is a graph illustrating potentials before and after current cut-off with current density=−0.200 A/cm$^2$, energization period $t_{on}$=0.5 to 5.0 s, and a Mo-made substrate used.

FIG. 3 is a graph illustrating potentials before and after the current cut-off with current density=−0.200 A/cm$^2$, energization period $t_{on}$=0.5 to 5.0 s, and the Mo-made substrate used. In addition, Table 1 gives non-energization periods $t_{off}$ that the potential takes to exceed a threshold value of −0.043 V with respect to the various energization periods $t_{on}$, and ratios therebetween.

TABLE 1

| $t_{on}$ | $t_{off}$ | $t_{off}/t_{on}$ |
|---|---|---|
| 1.5 | 0.40 | 0.267 |
| 2.0 | 0.55 | 0.275 |
| 2.5 | 0.75 | 0.300 |
| 3.0 | 0.95 | 0.317 |
| 3.5 | 1.15 | 0.329 |
| 4.0 | 1.30 | 0.325 |
| 4.5 | 1.50 | 0.333 |
| 5.0 | 1.70 | 0.340 |

As illustrated in the graph of FIG. 3 and given in Table 1, it is understood that as the energization period $t_{on}$ increases, the non-energization period $t_{off}$ increases, and the ratio of the non-energization period $t_{off}$ to the energization period $t_{on}$ also increases.

Here, in order to examine whether the assumption that the time taken by the potential to exceed the threshold value of −0.043 V after the current cut-off was set as the non-energization period $t_{off}$ was correct, the electrolysis was performed with a Mo-made substrate used, current density=−0.200 A/cm$^2$, energization period $t_{on}$=5.0 s, and non-energization period $t_{off}$=1.7 s.

Figure 4:
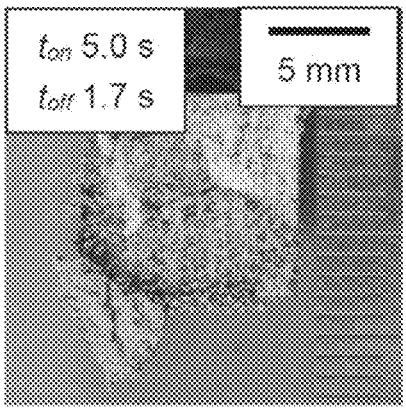
FIG. 4 is a picture illustrating a substrate subjected to electrolysis with energization period $t_{on}$=5.0 s, and non-energization period $t_{off}$=1.7 s.

FIG. 4 is a picture illustrating a substrate subjected to electrolysis with energization period $t_{on}$=5.0 s and non-energization period $t_{off}$=1.7 s. As understood from FIG. 4, a smooth electrodeposited titanium film was not obtained although the non-energization period $t_{off}$ was determined based on this assumption.

Next, in order to examine whether a smooth electrodeposited titanium film can be obtained with the energization period $t_{on}$=5.0 s, the electrolysis was performed using a Mo-made substrate, with current density=−0.200 A/cm$^2$, energization period $t_{on}$=5.0 s, and non-energization period $t_{off}$=5.0 s. At this point, the energizing amount was set at 545.0 C/cm$^2$ (equivalent to an electrodeposited titanium film having a thickness: 300 μm).

Figure 5:
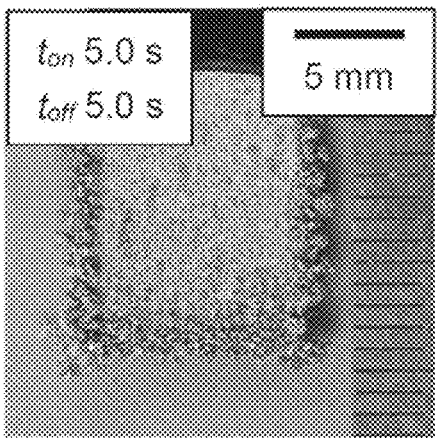
FIG. 5 is a picture illustrating a substrate subjected to electrolysis with energization period $t_{on}$=5.0 s, and non-energization period $t_{off}$=5.0 s.

FIG. 5 is a picture illustrating a substrate subjected to electrolysis with energization period $t_{on}$=5.0 s and non-energization period $t_{off}$=5.0 s. As understood from FIG. 5, by reserving the non-energization period $t_{off}$ sufficiently, a smooth electrodeposited titanium film was obtained even with non-energization period $t_{on}$=5.0 s.

From the above results, it is necessary to make a new assumption to determine the non-energization period $t_{off}$ from the potentials before and after the current cut-off.

Figure 6:
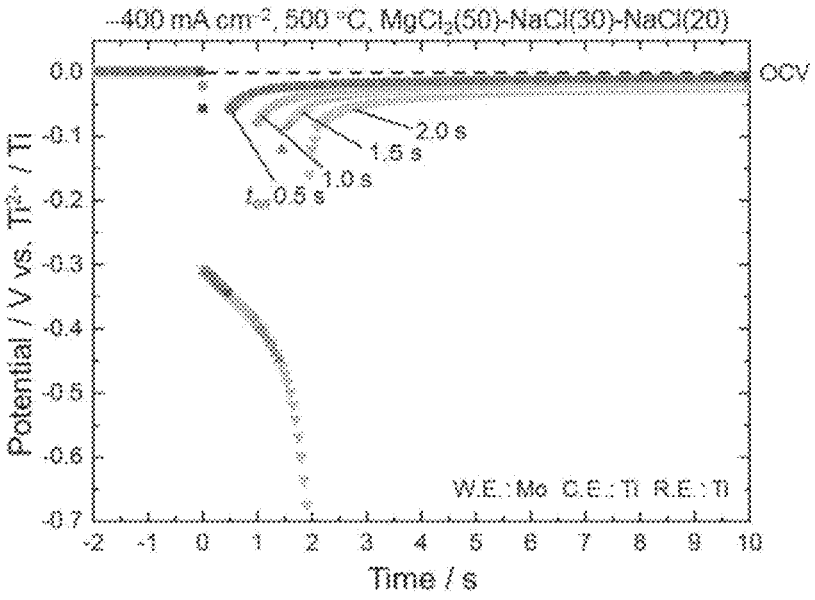
FIG. 6 is a graph illustrating potentials before and after current cut-off with current density=−0.400 A/cm$^2$, energization period $t_{on}$=0.5 to 2.0 s, and a Mo-made substrate used.
Figure 7:
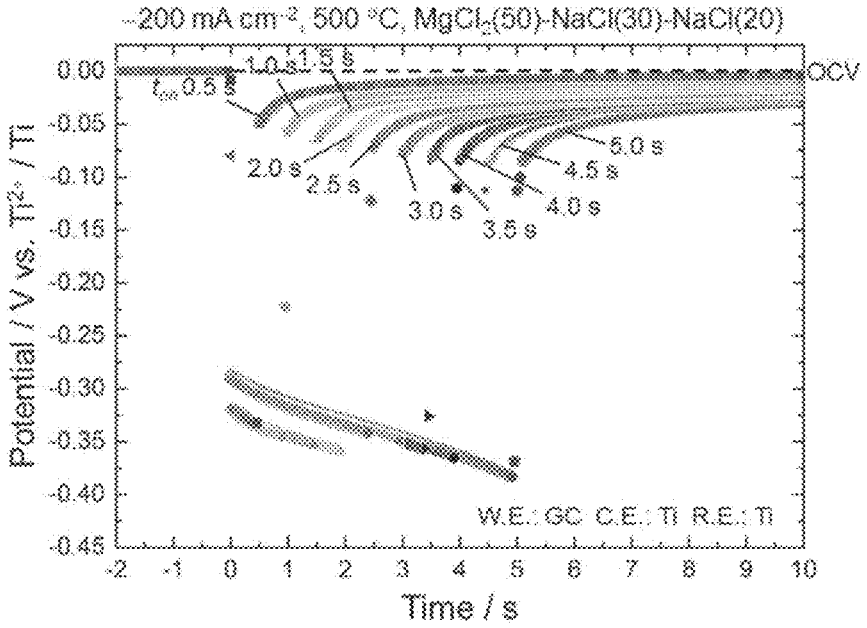
FIG. 7 is a graph illustrating potentials before and after current cut-off with current density=−0.200 A/cm$^2$, energization period $t_{on}$=0.5 to 5.0 s, and a glassy carbon-made substrate used.

FIG. 6 is a graph illustrating potentials before and after the current cut-off with current density=−0.400 A/cm$^2$, energization period $t_{on}$=0.5 to 2.0 s, and the Mo-made substrate used. FIG. 7 is a graph illustrating potentials before and after the current cut-off with current density=−0.200 A/cm$^2$, energization period $t_{on}$=0.5 to 5.0 s, and the glassy carbon-made substrate used. Note that, in the graphs of FIGS. 6 and 7, 0 s indicates a first point since a start of the application and measurement points were provided every 0.05 ms.

Although no investigations about the conditions for obtaining a smooth electrodeposited titanium film was conducted for the cases of FIGS. 6 and 7, there is a tendency substantially the same as that of the graph of FIG. 2 (the potentials before and after the current cut-off using the Mo-made substrate, with current density=−0.200 A/cm$^2$ and energization period $t_{on}$=0.5, 1.0 s). In the graph of FIG. 7, differences in potential immediately after the energization are recognized; it is inferred that the reason for this is that the measurement with energization period $t_{on}$=0.5 to 2.0 s and the measurement with energization period $t_{on}$=2.5 to 5.0 s were performed on different dates.

Figure 8:
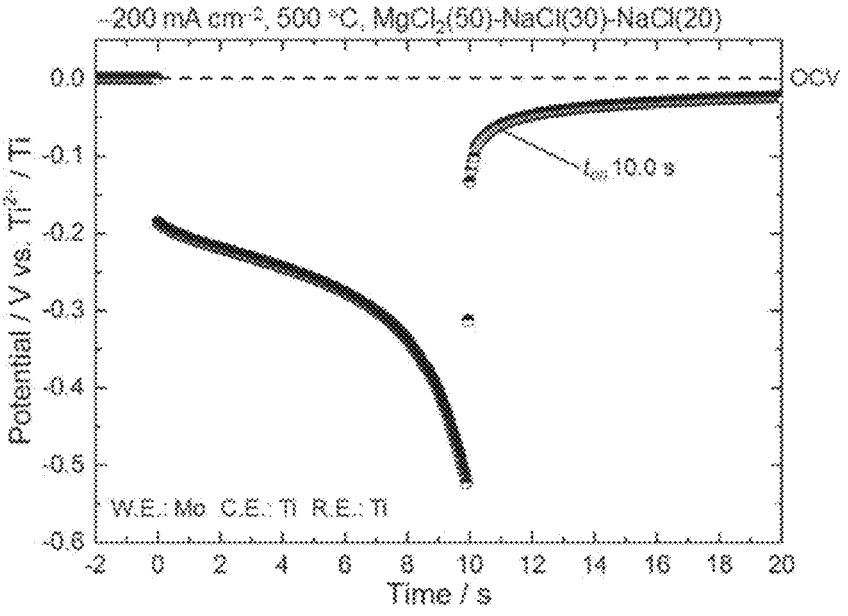
FIG. 8 is a graph illustrating potentials with current density=−0.200 A/cm$^2$, energization period $t_{on}$=10.0 s, and a Mo-made substrate used.
Figure 9:
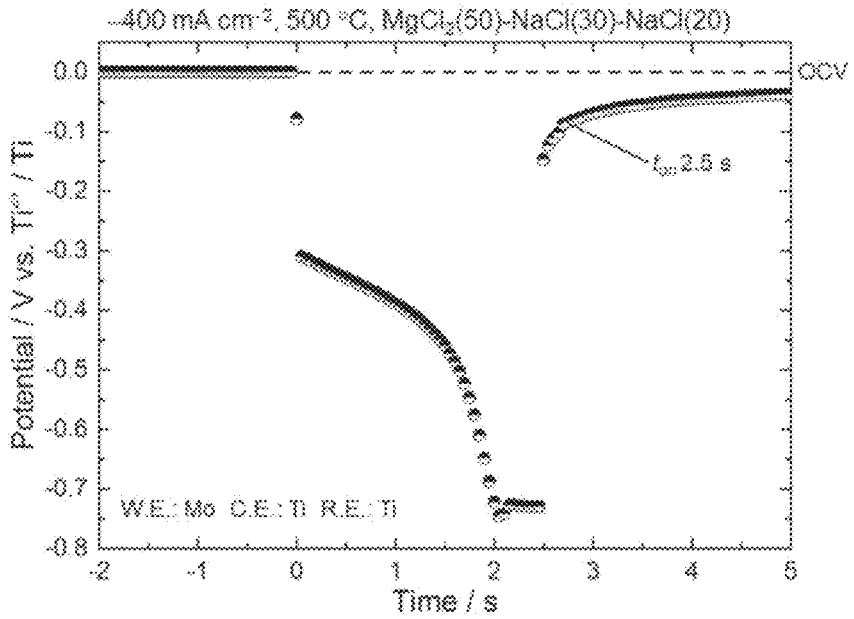
FIG. 9 is a graph illustrating potentials with current density=−0.400 A/cm$^2$, energization period $t_{on}$=2.5 s, and a Mo-made substrate used.
Figure 10:
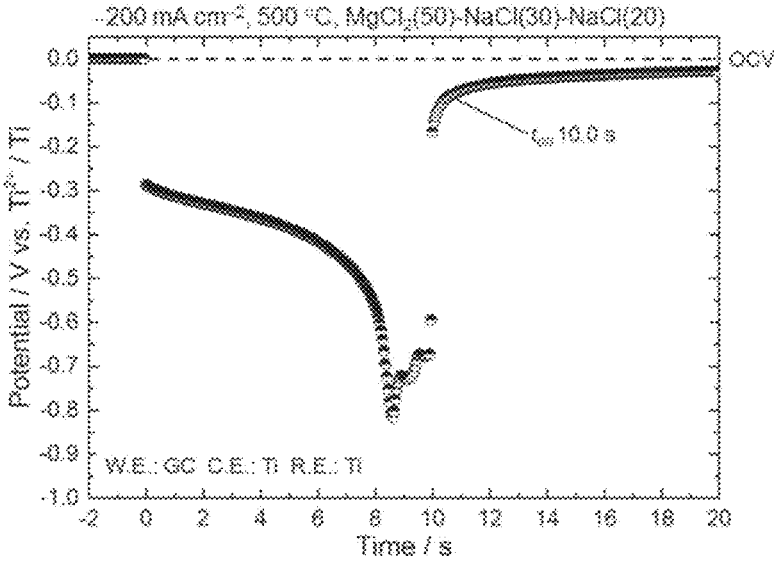
FIG. 10 is a graph illustrating potentials with current density=−0.200 A/cm$^2$, energization period $t_{on}$=10.0 s, and a glassy carbon-made substrate used.

FIG. 8 is a graph illustrating potentials with current density=−0.200 A/cm$^2$, energization period $t_{on}$=10.0 s, and the Mo-made substrate used. FIG. 9 is a graph illustrating potentials with current density=−0.400 A/cm$^2$, energization period $t_{on}$=2.5 s, and the Mo-made substrate used. FIG. 10 is a graph illustrating potentials with current density=−0.200 A/cm$^2$, energization period $t_{on}$=10.0 s, and the glassy carbon-made substrate used. Note that, in the graphs of FIGS. 8 to 10, 0 s indicates a first point since a start of the application and measurement points were provided every 0.05 ms.

From the graphs of FIGS. 8 to 10, it is understood that there are time points at which the potentials greatly change to bend negatively. It is preferable to set minimum conditions for the energization periods $t_{on}$ in a form of the time points at which these potential greatly change (ranges where the bending graphs change to be substantially linear).

From the above review, in a case of using the Mo-made substrate, the following (i) and (ii) are preferably satisfied, and in a case of using the glassy carbon-made substrate, the following (iii) is preferably satisfied.

(i) The period $t_{on}$ is set at not more than 5 s when the current density is −0.200 mA/cm$^2$.

(ii) The period $t_{on}$ is set at not more than 1.5 s when the current density is −0.400 mA/cm$^2$.

(iii) The period $t_{on}$ is set at not more than 5 s when the current density is −0.200 mA/cm$^2$.

By employing the electrolysis conditions described above, a smooth electrodeposited titanium film can be manufactured. Here, "being smooth" means that the electrodeposited substance has few pores, is dense, and has a surface with small unevenness. In addition, "not being smooth" means that protrusion-like or dendrite-like electrodeposited substances are scattered on the surface of the electrode, and there are many pores when the surface or a cross section of the electrode is observed.

(5) Separation of Electrodeposited Titanium Film From a Cathode Electrode

After the electrodeposited titanium film is formed in such a manner, a titanium foil is produced by separating the electrodeposited titanium film from the cathode electrode by performing one or both of a process of applying an external force to the electrodeposited titanium film and a process of removing at least a portion of the cathode electrode.

In the present invention, it is preferable to separate the electrodeposited titanium film from the electrode by grasping directly a portion of the electrodeposited titanium film and peeling the electrodeposited titanium film from the electrode or bonding a separation member to a portion of the electrodeposited titanium film, grasping the separation member, and peeling the electrodeposited titanium film from the electrode. The portion of the electrodeposited titanium film refers to a region serving as a possible starting point of peeling, such as a corner or an edge of the electrodeposited titanium film.

In a case where the cathode electrode will not be reused, a possible example is one in which at least the portion of the cathode electrode is removed by physical means such as grinding, cutting, polishing, ion milling, and blasting or chemical means such as etching, by which the electrodeposited titanium film is separated.

In the present invention, only one of the process of applying the external force to the electrodeposited titanium film and the process of removing at least the portion of the cathode electrode may be performed, but both of them are preferably performed. For example, the electrodeposited titanium film may be separated from the cathode electrode by, on an interface between the electrodeposited titanium film and the cathode electrode, removing a portion of the cathode electrode (e.g., a portion including a region serving as a possible starting point of the peeling, such as a corner and an edge of the electrodeposited titanium film of the electrodeposited titanium film) to form a grasping portion in the portion of the electrodeposited titanium film, and thereafter, peeling the electrodeposited titanium film from the cathode electrode with the grasping portion as the starting point or by bonding a separation member to the grasping portion and then peeling the electrodeposited titanium film from the cathode electrode with the separation member as the starting point.

Examples of a metal adhesive used to bond the separation member to the electrodeposited titanium film include "Metal Lock Y611 Black S" (trade name)," an acrylic adhesive from Cemedine co., ltd.

The removal of the cathode electrode is preferably performed by, for example, physical means such as grinding, cutting, polishing, ion milling, and blasting or chemical means such as etching.

According to the present invention, a titanium foil or a titanium sheet having a film thickness of about 100 μm to 1 mm can be produced without concurrent use of a physical action such as applying vibrations to a cathode electrode or agitating a molten salt bath, by causing a smooth electrodeposited titanium film to precipitate on a cathode electrode simply and separating the smooth electrodeposited titanium film from the cathode electrode reliably and quickly.

The titanium foil obtained by the present invention may be further reworked as necessary. This can further enhance a dimensional accuracy and mechanical properties of the titanium foil.

According to the present invention, a smooth titanium foil can be produced without performing a process of melting, casting, blooming, and in addition, repeating rolling and annealing, and without an increase in cost of peeling an electrodeposited titanium film from a cathode electrode, which thus enables a significant reduction in production costs through reduction in processes and improvement in yield.

A thickness of a titanium foil or a titanium sheet produced by the present invention is about 100 μm to 1 mm. According to "JIS H4600:2012 Titanium and titanium alloys-Sheets, plates and strips", a plate has a thickness of not less than 0.2 mm.

EXAMPLE 1

Investigations were conducted on possibilities of separation of electrodeposited titanium films electrodeposited on various kinds of substrates, and analyses of the electrodeposited titanium films were conducted.

(1) Experimental Method

The electrodeposition of titanium was performed by the following method.

Molten salt: $MgCl_2$—NaCl—KCl eutectic salt (Mg:Na:K=50:30:20/mol %) (5 mol % $TiCl_2$ (cation ratio))

Working electrode: Mo, stainless steel (SUS304), Fe, Ti, Nb, Ta, Ni, Counter electrode: Ti, Reference electrode: Ti Current density: −0.232 A/cm$^2$ Energizing amount: 908.3 C/cm$^2$ (equivalent to an electrodeposited titanium film having a thickness: 500 μm)

Pulse width: Energization period $t_{on}$=Non-energization period $t_{off}$=0.5 s After the electrolysis, the substrate used as the working electrode was subjected to leaching treatment to extract adhered salts in 5 mass % hydrochloric acid. Thereafter, the substrate and the electrodeposited titanium film were cut at a portion in a vicinity of their boundary, and from this portion, the electrodeposited titanium film was separated.

For electrodeposited titanium films electrodeposited on the Mo-made substrate and the SUS304-made substrate, a portion of each substrate was etched using an acid (sulfuric acid:nitric acid:water=1:1:3 for Mo, and 10 mass % HCl for SUS304) to form a holding portion used for applying external force to the electrodeposited titanium film to separate the electrodeposited titanium film from the substrate, grasping the holding portion of the electrodeposited titanium film and peeling the electrodeposited titanium film from the substrate, by which a titanium foil having a thickness equivalent to 500 μm that is calculated from energizing amount was obtained.

A substrate-side surface of the electrodeposited titanium film separated from the substrate was subjected to SEM observation and WDS analysis (wavelength-dispersive X-ray spectroscopic analysis) using an EPMA. In addition, from a difference in mass of a sample before and after the electrolysis, a current efficiency was determined.

(2) Experimental Results and Review

Figure 11:
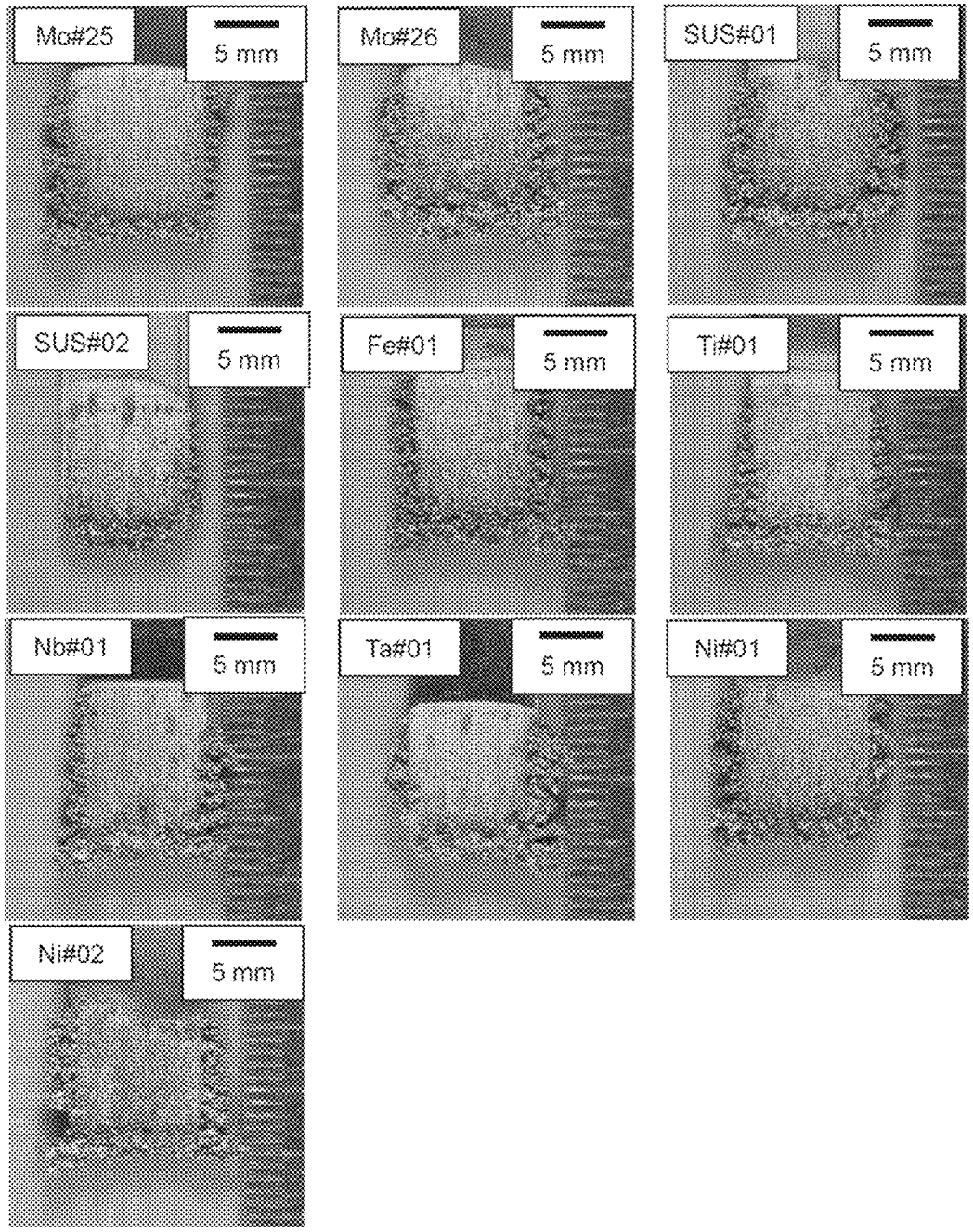
FIG. 11 includes pictures illustrating molten-salt-bath-side surfaces of electrodeposited titanium films electrodeposited on various kinds of substrates.

Table 2 gives current efficiencies and succeed/failure in the separation of the substrates. FIG. 11 includes pictures illustrating bath-side surfaces of electrodeposited titanium films electrodeposited on various kinds of substrates.

TABLE 2

| Substrate | Current efficiency (%) | Success/Failure in separation |
|---|---|---|
| Mo-made #01 | 62.60 | x (○ after etching) |
| Mo-made #02 | 55.22 | x |
| SUS-made #01 | 82.96 | x (Δ after etching) |
| SUS-made #02 | 35.60 | x |
| Fe-made #01 | 82.21 | x |
| Ti-made #01 | 56.73 | x |
| Nb-made #01 | 75.70 | x |
| Ta-made #01 | 65.61 | x |
| Ni-made #01 | 70.48 | x |
| Ni-made #02 | 70.17 | ○ |

Of the various kinds of substrates subjected to this test, substrates with which electrodeposited titanium films were successfully separated by the above method, including "after etching", include Mo-made #01 substrate and Ni-made #02 substrate. With SUS-made #01 substrate, a part of an electrodeposited titanium film can be separated after the etching, but the electrodeposited titanium film was torn during its separation.

Figure 12:
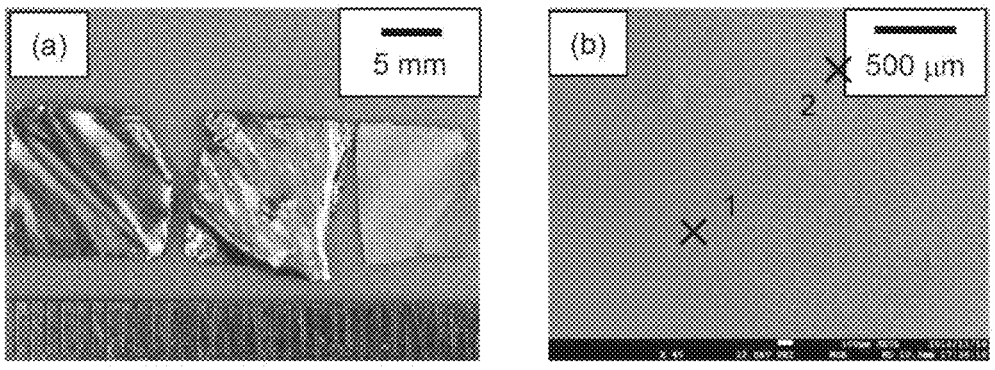
FIG. 12(*a*) is a picture illustrating a substrate-side surface of an electrodeposited titanium film electrodeposited on Mo-made #01 substrate, and FIG. 12(*b*) is a secondary electron image (40×) of the substrate-side surface of the electrodeposited titanium film electrodeposited on Mo-made #01 substrate.

FIG. 12(*a*) is a picture illustrating a substrate-side surface of an electrodeposited titanium film electrodeposited on Mo-made #01 substrate, and FIG. 12(*b*) is a secondary electron image (40×) of the substrate-side surface of the electrodeposited titanium film electrodeposited on Mo-made #01 substrate.

Figure 13:
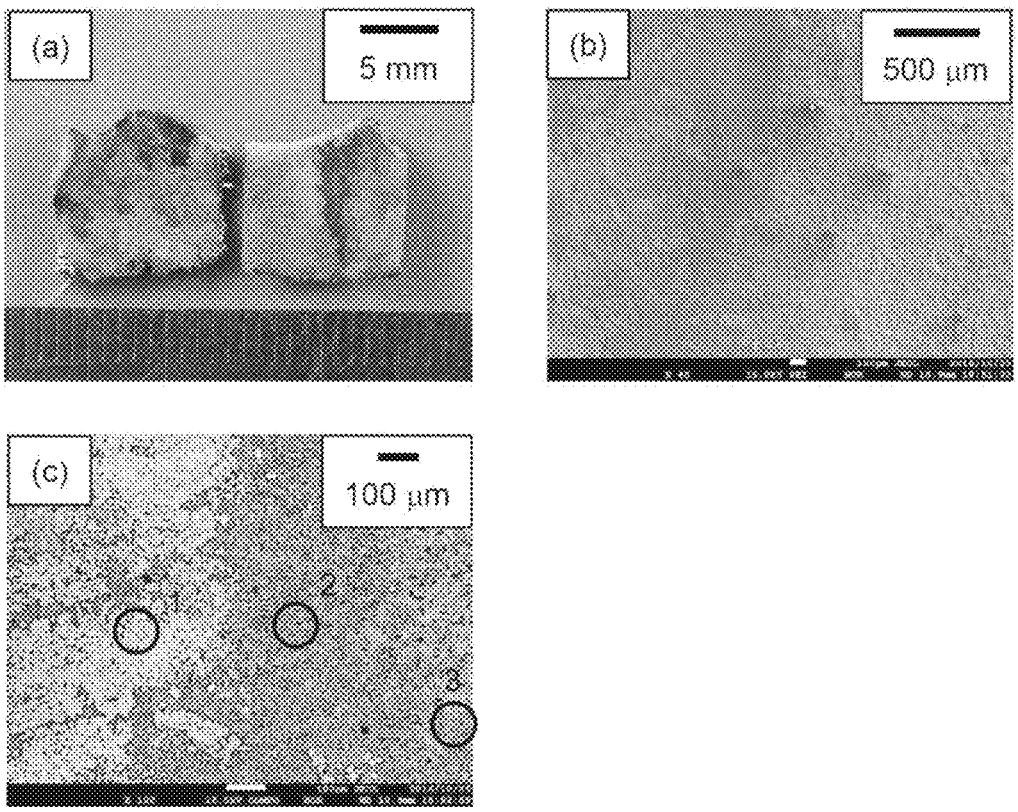
FIG. 13(*a*) is a picture illustrating a substrate-side surface of an electrodeposited titanium film electrodeposited on Ni-made #02 substrate, FIG. 13(*b*) is a secondary electron image (40×) of the substrate-side surface of the electrodeposited titanium film electrodeposited on Ni-made #02 substrate, and FIG. 13(*c*) is an enlarged image (100×) of FIG. 13(*b*).

FIG. 13(*a*) is a picture illustrating a substrate-side surface of an electrodeposited titanium film electrodeposited on Ni-made #02 substrate, FIG. 13(*b*) is a secondary electron image (40×) of the substrate-side surface of the electrodeposited titanium film electrodeposited on Ni-made #02 substrate, and FIG. 13(*c*) is an enlarged image (100×) of FIG. 13(*b*).

Figure 14:
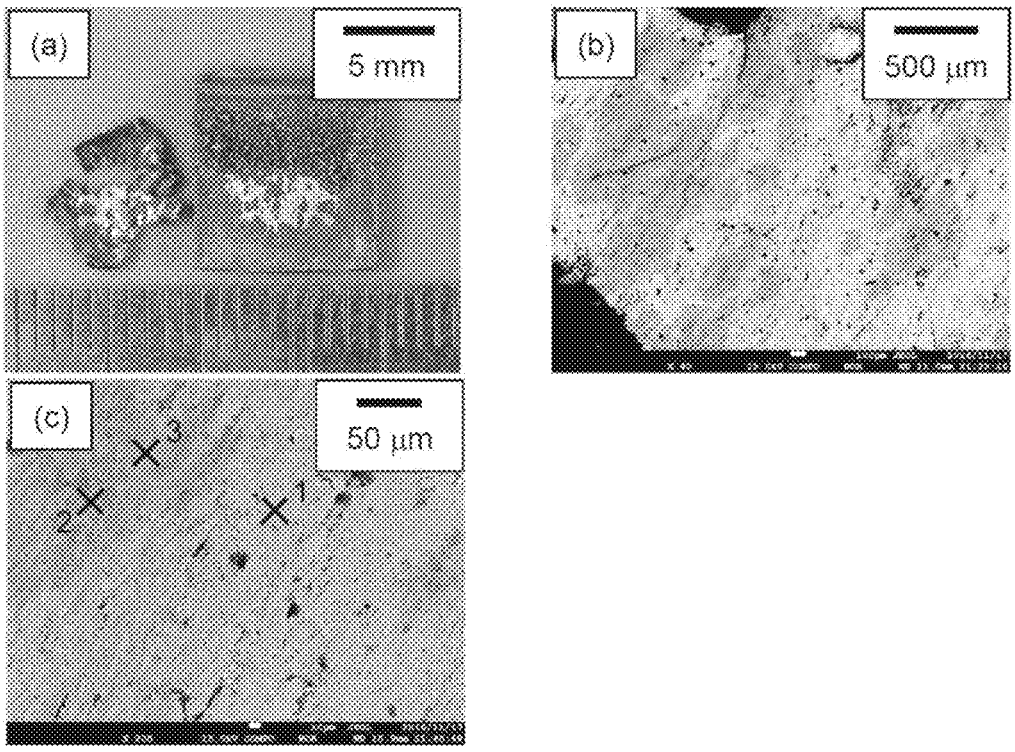
FIG. 14(*a*) is a picture illustrating a substrate-side surface of an electrodeposited titanium film electrodeposited on Stainless-steel-made #01 substrate, FIG. 14(*b*) is a backscattered electron image (40×) of the substrate-side surface of the electrodeposited titanium film electrodeposited on Stainless-steel-made #01 substrate, and FIG. 14(*c*) is an enlarged image (300×) of FIG. 14(*b*).

In addition, FIG. 14(*a*) is a picture illustrating a substrate-side surface of an electrodeposited titanium film electrodeposited on SUS-made #01 substrate, FIG. 14(*b*) is a back-scattered electron image (40×) of the substrate-side surface of the electrodeposited titanium film electrodeposited on SUS-made #01 substrate, and FIG. 14(*c*) is an enlarged image (300×) of FIG. 14(*b*).

As illustrated in FIG. 12(*a*) to FIG. 12(*b*), Mo-made #01 substrate produced an electrodeposited titanium film that was uniform and had few gaps; in contrast, as illustrated in FIG. 13(*a*) to FIG. 13(*c*) and FIG. 14(*a*) to FIG. 14(*c*), it can be seen that Ni-made #02 substrate and SUS-made #01 substrate produced electrodeposited titanium films having pores and portions of different textures.

Table 3 gives results of quantitative analysis (at %) conducted on pointed spots 1 and 2 on FIG. 12(*b*), Table 4 gives results of quantitative analysis (at %) conducted on three circled spots on FIG. 13(*c*), and in addition, Table 5 gives results of quantitative analysis (at %) conducted on pointed spots 1 to 3 on FIG. 14(*c*).

TABLE 3

| | Ti | O | Mo |
|---|---|---|---|
| 1 | 93.50 | 6.48 | 0.02 |
| 2 | 93.49 | 6.48 | 0.03 |

TABLE 4

| | Ti | O | Ni |
|---|---|---|---|
| 1 | 63.78 | 26.15 | 10.07 |
| 2 | 83.68 | 13.18 | 3.14 |
| 3 | 85.99 | 12.18 | 1.83 |

TABLE 5

| | Ti | O | C | Fe | Ni | Cr |
|---|---|---|---|---|---|---|
| 1 | 88.93 | 8.89 | 2.08 | 0.06 | 0.01 | 0.03 |
| 2 | 36.82 | 46.12 | 2.79 | 7.99 | 2.81 | 3.47 |
| 3 | 43.39 | 38.03 | 3.42 | 8.92 | 2.97 | 3.26 |

As given in Table 3, very little Mo is present on Mo-made #01 substrate. In contrast, as given in Tables 4 and 5, it can be seen that Ni-made #02 substrate and SUS-made #01 substrate include many portions that contain metallic elements originating from Ni-made #02 substrate and SUS-made #01 substrate.

EXAMPLE 2

By using cross sections of electrodeposited titanium films electrodeposited on a glassy carbon-made substrate and a graphite-made substrate, and the substrates, how carbon diffused in and adhered on electrodeposited titanium films was investigated by conducting observation and analysis on substrate sides of the electrodeposited titanium films.

(1) Experimental Method

The electrodeposition of titanium was performed by the following method.

Molten salt: $MgCl_2$—NaCl—KCl eutectic salt (Mg:Na:K=50:30:20/mol %) (5 mol % $TiCl_2$ (cation ratio))

Working electrode: glassy carbon (glassy carbon-made #01, 02) and graphite (graphite-made #01, 02), Counter electrode: Ti, Reference electrode: Ti Current density: −0.232 A/cm$^2$ Energizing amount: 900.5 C/cm$^2$ (equivalent to an electrodeposited titanium film having a thickness: 500 μm)

After the electrolysis, the substrate used as the working electrode was subjected to leaching treatment to extract adhered salts in 5 mass % hydrochloric acid. X-ray diffraction analysis was thereafter conducted on Glassy carbon-made #01 and Graphite-made #01 from which titanium films were peeled. Glassy carbon-made #02 and Graphite-made #02 were cut after embedded in resin.

Substrate-side surfaces of the peeled electrodeposited titanium films and cross sections of the substrates embedded in resin were subjected to SEM observation and WDS analysis (wavelength-dispersive X-ray spectroscopic analysis) using an EPMA. In addition, from a difference in mass of a sample before and after the electrolysis, a current efficiency was determined.

(2) Experimental Results and Review

Table 6 gives experimental conditions and current efficiency of each substrate.

TABLE 6

| Substrate | Current density ($A/cm^2$) | Energizing amount ($C/cm^2$) | Current efficiency (%) |
|---|---|---|---|
| Glassy carbon-made #01 | −0.232 | 900.5 | 80.3 |
| Glassy carbon-made #02 | | | 82.4 |
| Graphite-made #01 | | | 80.5 |
| Graphite-made #02 | | | 91.7 |

As given in Table 6, the current efficiencies fell within the range from 80% to about 90%.

Figure 15:
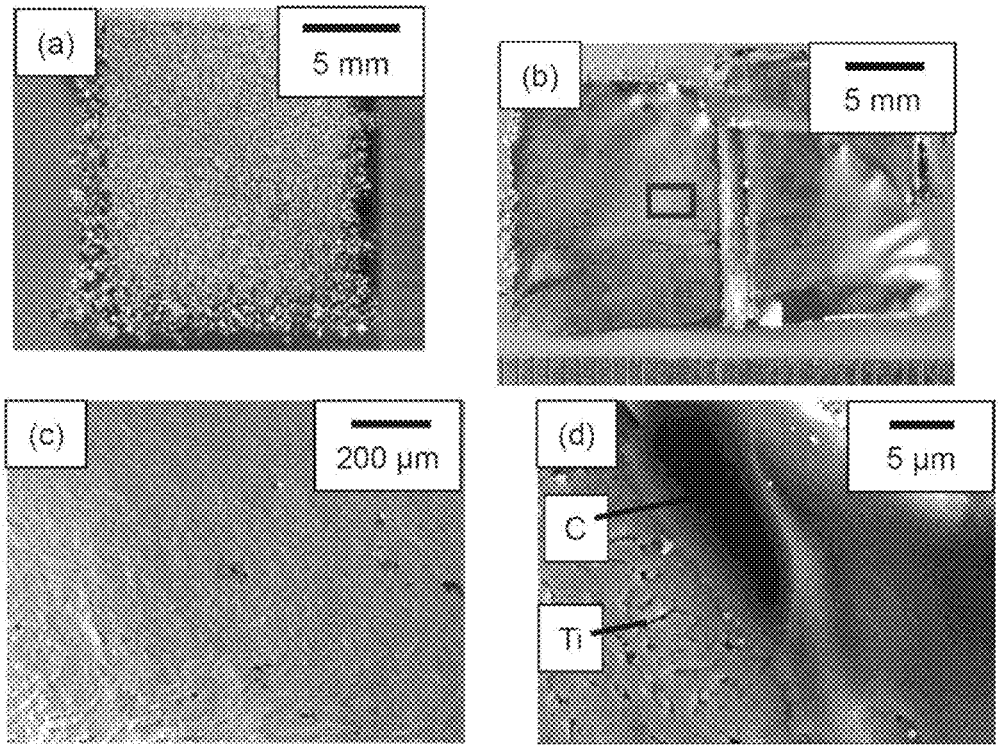
FIG. 15(*a*) is a picture illustrating a molten-salt-bath-side surface of an electrodeposited titanium film obtained using Glassy carbon-made #01 substrate, FIG. 15(*b*) is a picture illustrating a substrate-side surface of the electrodeposited titanium film obtained using Glassy carbon-made #01 substrate, FIG. 15(*c*) is a secondary electron image of a framed area in FIG. 15(*b*), and FIG. 15(*d*) is an enlarged secondary electron image of a framed area in FIG. 15(*c*).

FIG. 15(*a*) is a picture illustrating a bath-side surface of an electrodeposited titanium film obtained using Glassy carbon-made #01 substrate, FIG. 15(*b*) is a picture illustrating a substrate-side surface of the electrodeposited titanium film obtained using Glassy carbon-made #01 substrate, FIG. 15(*c*) is a secondary electron image of a framed area in FIG. 15(*b*), and FIG. 15(*d*) is an enlarged secondary electron image of a framed area in FIG. 15(*c*).

As illustrated in FIGS. 15(*a*) to 15(*d*), particularly in FIG. 15(*d*), it can be seen that a slight amount of carbon (C) adheres to the substrate-side surface of the peeled electrodeposited titanium film.

Figure 16:
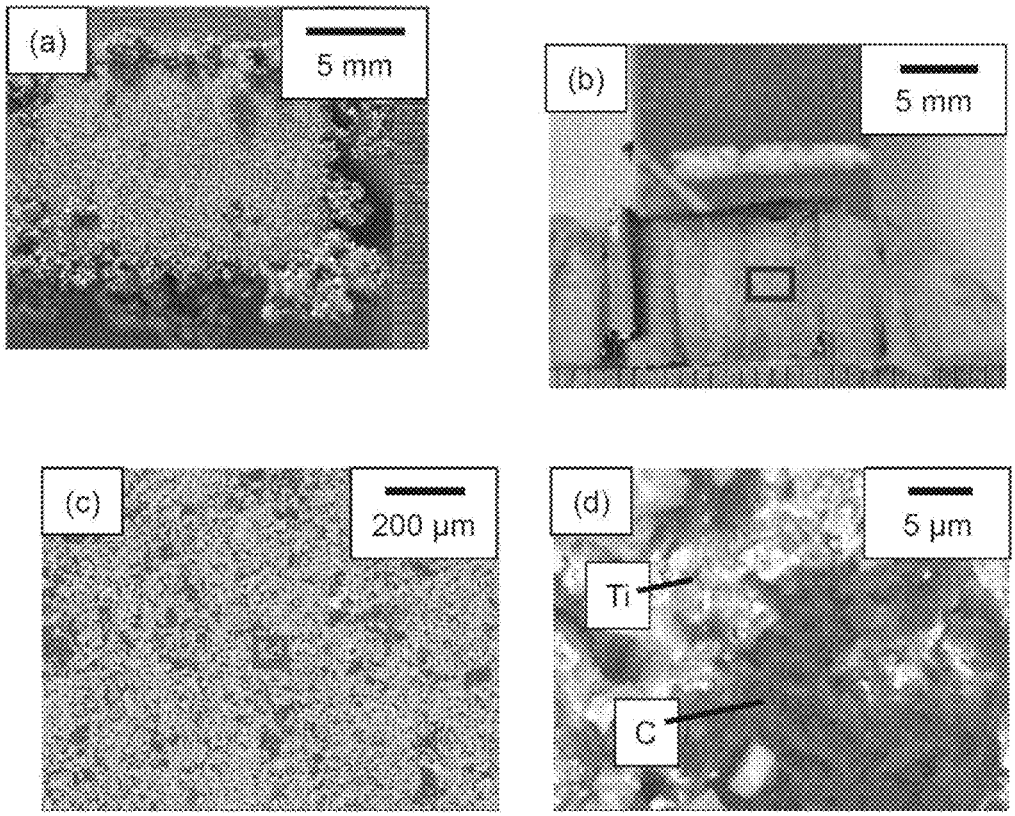
FIG. 16(*a*) is a picture illustrating a molten-salt-bath-side surface of an electrodeposited titanium film obtained using Graphite-made #01 substrate, FIG. 16(*b*) is a picture illustrating a substrate-side surface of the electrodeposited titanium film obtained using Graphite-made #01 substrate, FIG. 16(*c*) is a backscattered electron image of a framed area in FIG. 16(*b*), and FIG. 16(*d*) is an enlarged backscattered electron image of a framed area in FIG. 16(*c*).

FIG. 16(*a*) is a picture illustrating a bath-side surface of an electrodeposited titanium film obtained using Graphite-made #01 substrate, FIG. 16(*b*) is a picture illustrating a substrate-side surface of the electrodeposited titanium film obtained using Graphite-made #01 substrate, FIG. 16(*c*) is a backscattered electron image of a framed area in FIG. 16(*b*), and FIG. 16(*d*) is an enlarged backscattered electron image of a framed area in FIG. 16(*c*).

As illustrated in FIGS. 16(*a*) to 16(*d*), it can be seen that the substrate-side surface of the titanium film peeled from the graphite substrate is uneven as compared with the case of the glassy carbon substrate, and a large amount of carbon (C) adheres thereto.

Figure 17:
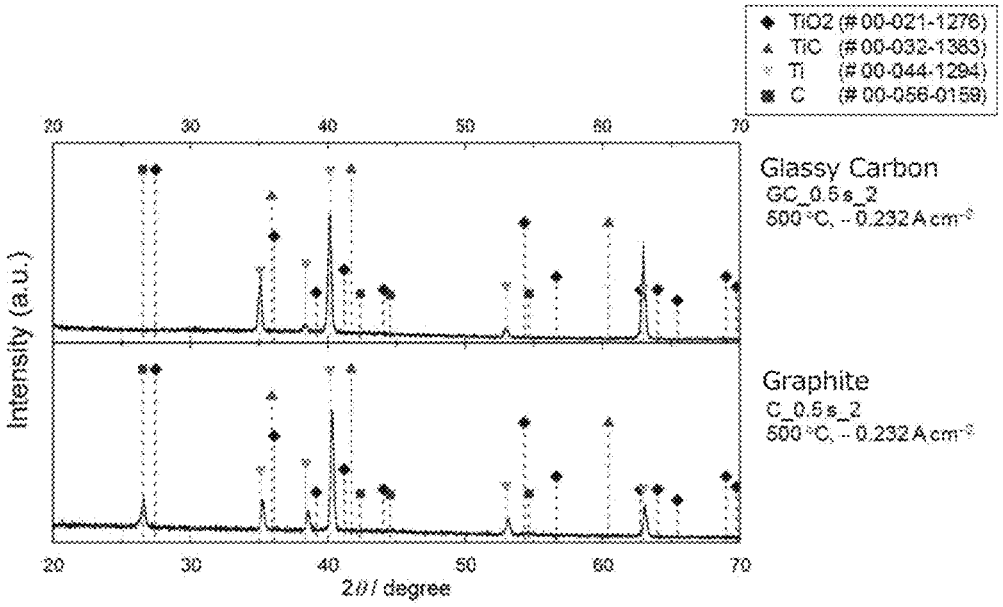
FIG. 17 is a graph illustrating results of X-ray diffraction analysis conducted on the electrodeposited titanium films peeled from Glassy carbon-made #01 substrate and Graphite-made #01 substrate.

FIG. 17 is a graph illustrating results of X-ray diffraction analysis conducted on the electrodeposited titanium films peeled from Glassy carbon-made #01 substrate and Graphite-made #01 substrate.

As illustrated in the graph of FIG. 17, only Ti was detected from Glassy carbon-made #01 substrate. In contrast, from Graphite-made #01 substrate, graphite (#00-056-0159) was also detected. TiC was not detected. In comparison with the EPMA results, it is considered that the adhesion of carbon was small on the glassy carbon-made substrate.

EXAMPLE 3

By the same experimental method as Example 2, electrodeposited titanium films were formed on cathode electrodes (substrates) made of Mo, SUS, Ti, Nb, Ta, Ni, glassy carbon, and graphite, and whether the electrodeposited titanium films could be peeled by hand or by means other than by hand, and in addition, whether impurities originating from the substrates were present on the peeled surface of the substrates were checked.

Figure 18:
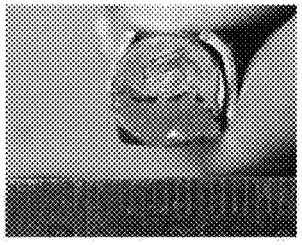
FIG. 18 includes pictures illustrating bath-side surfaces of electrodeposited titanium films electrodeposited on Mo-made #03 substrate, Mo-made #01 substrate, stainless-steel (SUS)-made #01 substrate, and Ni-made #02 substrate, and secondary electron images (40×) of substrate-side surfaces of the electrodeposited titanium films.
Figure 18:
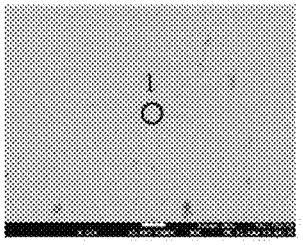
Figure 18:
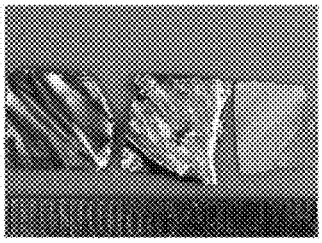
Figure 18:
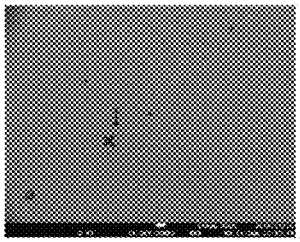
Figure 18:
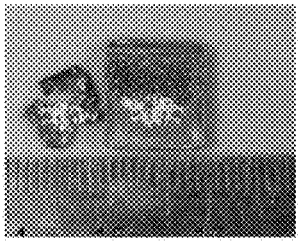
Figure 18:
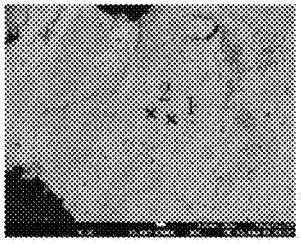
Figure 18:
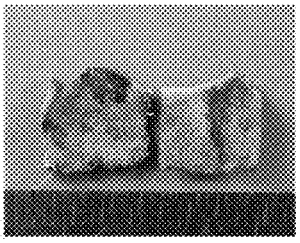
Figure 18:
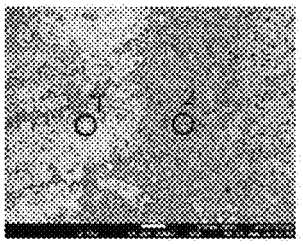
Figure 19:
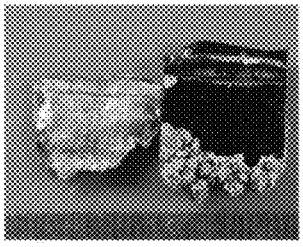
FIG. 19 includes pictures illustrating bath-side surfaces of electrodeposited titanium films electrodeposited on Glassy carbon-made #01-1 substrate, Glassy carbon-made #01-2 substrate, and Graphite-made #02 substrate, and secondary electron images (40×) of substrate-side surfaces of the electrodeposited titanium films.
Figure 19:
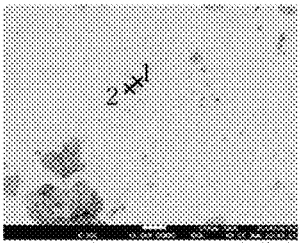
Figure 19:
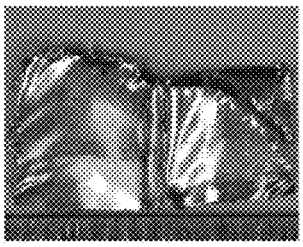
Figure 19:
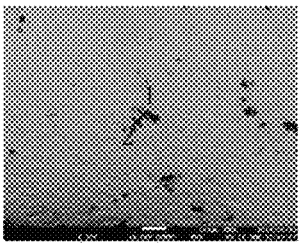
Figure 19:
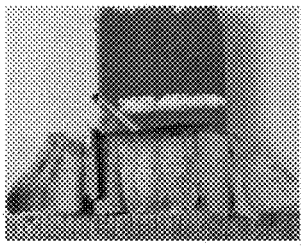
Figure 19:
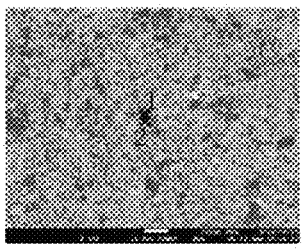

Results of the checks are illustrated in FIGS. 18 and 19 and collectively given in Table 7.

TABLE 7

| | Peeled by hand | Peeled by other means | Impurities on peeled surface originating from substrate |
|---|---|---|---|
| Mo #03 | x | Metal adhesive Δ (torn during separation) | Absent |
| Mo #01 | x | Etching ○ | Absent |
| SUS #01 | x | Etching Δ (torn during separation) | Present (Fe, Cr, Ni) |
| Ti #01 | x | Metal adhesive x | — |
| Nb #01 | x | Metal adhesive x | — |
| Ta #01 | x | Metal adhesive x | — |
| Ni #01 | x | Metal adhesive x | — |
| Ni #02 | ○ | — | Present (Ni) |
| Glassy carbon-made #01-1 | ○ | — | A little (C) |
| Glassy carbon -made #01-2 | ○ | — | Absent |
| Graphite-made #02 | ○ | — | Present (C) |

FIG. 18 and FIG. 19 include pictures illustrating bath-side surfaces of electrodeposited titanium films electrodeposited on Mo-made #03 substrate, Mo-made #01 substrate, stainless-steel (SUS)-made #01 substrate, Ni-made #02 substrate, Glassy carbon-made #01-1 substrate, Glassy carbon-made #01-2 substrate, and Graphite-made #02 substrate, and secondary electron images (40×) of substrate-side surfaces of the electrodeposited titanium films.

As illustrated in FIG. 18 and FIG. 19, and given in Table 7, none of the means succeeded in peeling the electrodeposited titanium films from the Nb-made and Ta-made substrates, whereas the electrodeposited titanium films were successfully peeled by hand from the glassy carbon-made, graphite-made, and Ni-made substrates. From the Mo-made substrate, the electrodeposited titanium film could not be peeled by hand but could be obtained by etching the substrate.

Additionally, contamination on the peeled surface from the glassy carbon-made, graphite-made, Ni-made, and Mo-made substrates, was practically at insignificant levels.

The invention claimed is:

1. A method for producing a titanium foil or a titanium sheet by electrodeposition from molten salt using constant current pulse, the method comprising:

forming an electrodeposited titanium film on a surface of a cathode electrode made of one or more kinds selected from glassy carbon, graphite, Mo, and Ni, and thereafter separating the electrodeposited titanium film from the cathode electrode, wherein the separating process comprises steps of: on an interface between the electrodeposited titanium film and the cathode electrode, forming a grasping portion in the electrodeposited titanium film by removing a portion of the cathode electrode, and thereafter, a) peeling the electrodeposited titanium film from the cathode electrode with the grasping portion as a starting point, or b) bonding a separation member to the grasping portion and then peeling the electrodeposited titanium film from the cathode electrode with the separation member as the starting point.

2. The method for producing a titanium foil or a titanium sheet according to claim 1, wherein the process of removing comprises a step of:

removing by physical means or chemical means.

* * * * *